United States Patent [19]

Loiselle et al.

[11] Patent Number: 4,842,212

[45] Date of Patent: Jun. 27, 1989

[54] APPARATUS FOR SEAMING PAPERMAKER'S FABRIC

[75] Inventors: Andre Loiselle; Jacques Cadieux, both of Quebec, Canada

[73] Assignee: Asten Group, Inc., Charleston, S.C.

[21] Appl. No.: 204,937

[22] Filed: Jun. 6, 1988

Related U.S. Application Data

[63] Continuation of Ser. No. 40,948, Apr. 21, 1987, abandoned.

[51] Int. Cl.[4] ..... B65H 75/02; B65D 85/66

[52] U.S. Cl. ..... 242/96; 206/402; 206/409

[58] Field of Search ..... 242/96, 84.8, 85.1, 242/84.2 J, 100, 85, 137, 137.1, 138, 118; 206/389, 398, 402, 409, 403

[56] References Cited

U.S. PATENT DOCUMENTS

| | | | |
|---|---|---|---|
| 232,168 | 9/1880 | Beardslee | 242/85 |
| 1,096,963 | 5/1914 | Sweeney | 242/84.8 |
| 2,201,305 | 5/1940 | Springer | 242/96 X |
| 3,078,058 | 2/1963 | Roe | 242/96 X |
| 4,036,451 | 7/1977 | Pipkin | 206/389 X |
| 4,200,249 | 4/1980 | Synstelien et al. | 242/96 |
| 4,475,652 | 10/1984 | Heard | 206/389 X |

FOREIGN PATENT DOCUMENTS

| | | | |
|---|---|---|---|
| 8233733 | 9/1983 | Fed. Rep. of Germany . | |
| 8633964 | 4/1987 | Fed. Rep. of Germany . | |
| 388617 | 3/1933 | United Kingdom | 206/402 |

*Primary Examiner*—David Werner
*Attorney, Agent, or Firm*—Volpe and Koenig

[57] ABSTRACT

An apparatus for a pintle yarn/guide wire combination used to close a seam in a papermakers fabric. The pintle yarn/guide wire combination is wound upon a spool which is partially enclosed by a cover. The spool and cover can be reversibly rotated with respect to each other to allow unwinding or respooling of the pintle yarn/guide wire combination during the seaming operation.

7 Claims, 2 Drawing Sheets

APPARATUS FOR SEAMING PAPERMAKER'S FABRIC

This is a Continuation of application Ser. No. 040,948, filed April 21 1987 now abandoned.

BACKGROUND OF THE INVENTION

In the manufacture of paper, fabric belts are employed in the papermaking machines, such fabric belts may be formed from an endless loop which is woven as an endless loop or may be formed as flat segments whose ends are joined by a seam. Both methods have distinct advantages and disadvantages, typically endless belts are more complex to manufacture and more difficult to install. Installation of such endless belts or loops often requires partial disassembly of the papermaking machine for insertion. Such endless belts are employed however, because they do not have a seam which can effect product quality. Belts formed as flat segments whose ends are joined by a seam are much simpler to install in a papermaking machine. However, insertion of a pintle yarn or yarns which are employed to close the seam can be a difficult task. Also, the seam area can often result in undesirable marks on the product. Often, such pintle yarn or yarns are shaped for example flat or round having a flat side and two pintle yarns are employed one being inserted from each side of the belt. The proper alignment of the pintle within the fabric seam can be difficult to obtain, especially when pintles of other than circular cross sections are employed.

In the past, wire guides or leads have been attached to pintle yarns to assist in threading the pintle yarn through the fabric seam. Such guide wires were relatively stiff in comparison to the pintle yarn to make insertion easier. However, the attachment of a long relatively stiff guide wire to a pintle yarn results in a combination which is difficult to handle. Often, the guide wire and/or the attached pintle yarn can become tangled or kinked. Problems with tangling are especially prevalent when pintles with other than a round cross section are being employed which require a specific orientation within the seam. In order to properly orient the pintle in the seam, it is often necessary to remove the guide wire and start over, resulting in a free guide wire and pintle which easily becomes tangled or kinked.

SUMMARY OF THE PRESENT INVENTION

The present invention provides an easily manipulated pintle yarn and guide wire spool apparatus for use in seaming papermaking fabric. The present invention provides an apparatus which allows an operator inserting a pintle yarn to use a guide wire which may be easily respooled during repeated insertion or withdrawal to obtain a desired orientation and further can be reused after respooling of the guide wire and pintle yarn. The present invention further provides a convenient shipping and handling apparatus for a pintle yarn guide wire combination.

DETAILED DESCRIPTION OF THE PREFERRED EMBODIMENT

Figure 1A:
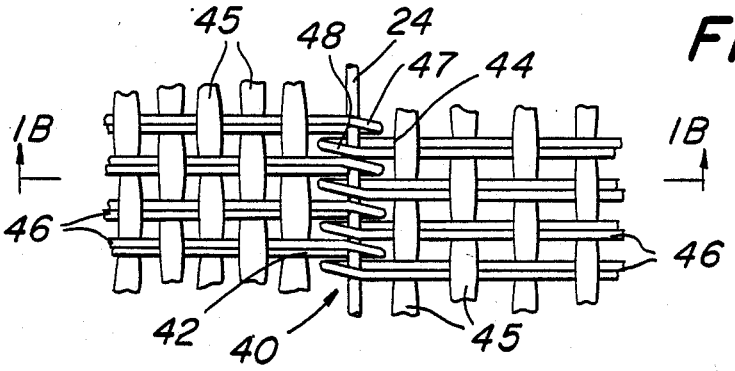
FIG. 1A is a plan view of a pin seam in a papermakers fabric.
Figure 1B:
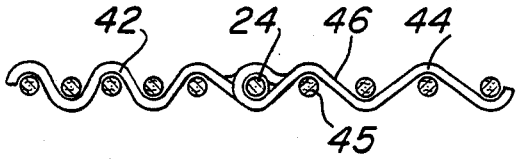
FIG. 1B is a side view taken along line B—B of FIG. 1A.

FIG. 1A is a top plan view of a typical seam in a papermakers' fabric. The seam 40 connects a first end 42 of a fabric belt to a second end 44 of the belt to form an endless loop. The seam 40 forms a part of a woven base onto which unwoven batts are needled. The woven base can be a single ply as shown or can be multi-ply. The woven base comprises cross machine direction threads 45 and machine direction threads 46. The exposed ends of the machine direction threads 46 are formed into loops 47 and 48 on fabric ends 42 and 44 respectively. The loops 47 and 48 intermesh in an alternating fashion to form a substantially tubular opening through which pintle 24 is inserted to close the seam.

Figure 2:
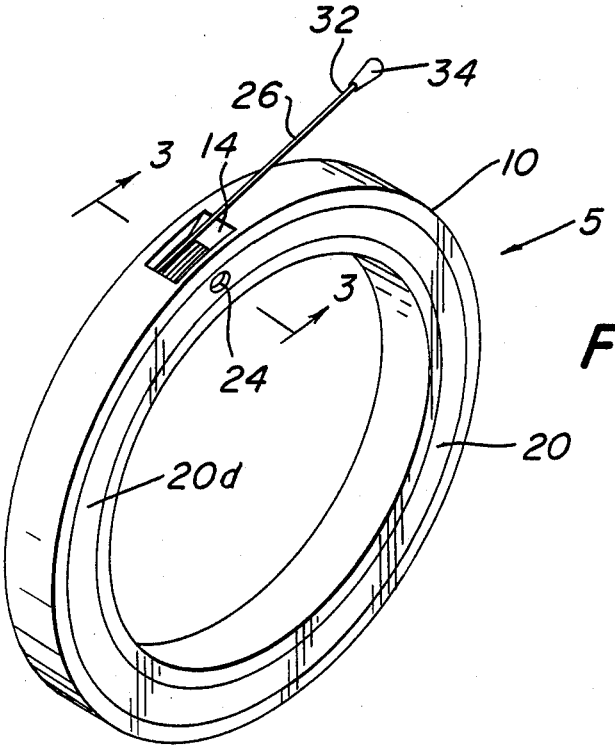
FIG. 2 is a perspective view of the present invention.

The present invention comprises a generally ring shaped apparatus as shown in FIG. 2. In the preferred embodiment the apparatus is approximately 8 inches in diameter. The apparatus 5 is easily held in the hand while the guide wire is being inserted in a fabric seam 40 as more fully described herein below. The apparatus 5 includes a circular element, cover 10 having a "U" shape cross section with the uprights of the "U" shape **10*a* and 10*b* being substantially parallel. The opened end 10*c* of the "U" shape is preferably on a radial surface of the tubular shape rather than a circumferential surface. The cover 10 includes an opening 14 which extends through the outer circumferential upright 10*a* of the "U" shape. The base 10*d* of the "U" shape, formed opposite the opened end 10*c* can include means to mount or grip the cover 10 such as holes 16**.

Figure 3:
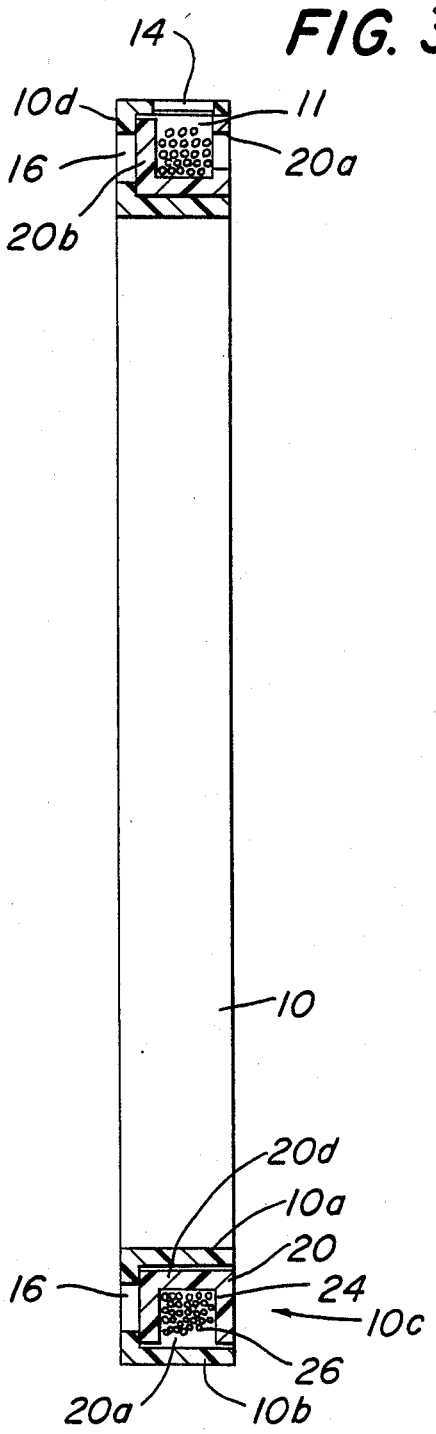
FIG. 3 is a cross section taken along line 3—3 of FIG. 2.
Figure 4:
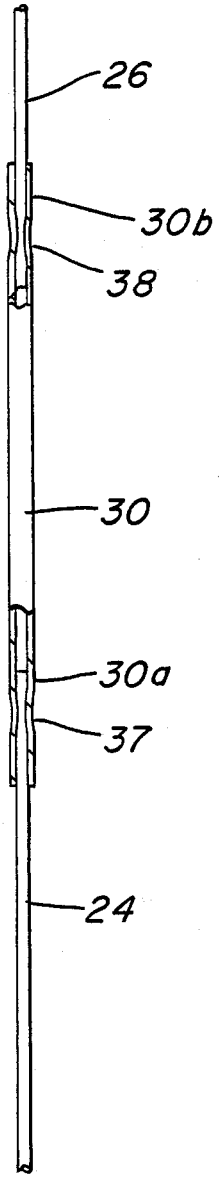
FIG. 4 is an enlargement partially in cross section of the swedge connection of the present invention.

A spool 20 adapted to fit between the uprights **10*a* and 10*b* of cover 10, substantially filling the space therebetween is provided. Spool 20 is a circularly shaped element preferably having a substantially "U" shape cross section with the opening 20*a* of the "U" shape being oriented on the outer circumferential surface. Orientation of the spool 20 within the cover 10 defines a cavity 11 adapted to receive windings of pintle yarn 24 and guide wire 26, FIG. 3**.

The spool 20 preferably fits closely within the cover 10 such that relative rotation between spool 20 and cover 10 is possible but with sufficient frictional contact that spool 20 is retained within cover 10. To provide the desired close fit between cover 10 and spool 20, the dimension of the cover 10 and spool 20 are carefully controlled during molding or machining of the parts. For example, the gap between leg **10*a* and base 20*d* can preferably range from 0.005 in. to 0.01 in. and is more preferably between 0.005 in. and 0.007 in. Similarly, the gap between the distal ends of uprights 20*a* and 20*b* and upright 10*b*** can preferably range from 0.005 in. to 0.01 in. and is more preferably between 0.005 in. and 0.007 in.

While cover 10 and spool 20 are shown as having "U" shapes in cross-section which interfit to form cavity 11, the cover 10 and spool 20 can be easily adapted to other shapes. The required shapes of spool 20 and cover 10 are such that they define a cavity 11 adapted to receive pintle yarn/guide wire combination and allow relative rotation between the cover 10 and spool 20. The shapes of spool 20 and cover 10 also expose a portion of both cover 10 and spool 20 so that it is possible to rotate the spool 20 with respect to cover 10 in either direction. Also, it is preferable that spool 20 be releasably held in position by cover 10 or vice versa.

The spool 20 is adapted to receive windings of pintle yarn 24 and guide wire 26 thereon. The pintle yarn 24 is attached at one end to the spool and wound onto spool 20 with guide wire 26 attached to the free end of pintle yarn 24 and wound about the spool concentric with the pintle yarn 24. The guide wire 26 is attached to the pintle yarn 24 by a swedge 30 which is a tubular element adapted to receive the pintle yarn 24 in a first end **30*a* and the guide wire 28 in a second end 30*b*. The swedge 30 is then crimped, as at 37 and 38, to grip the pintle yarn 24 and the guide wire 26** respectively.

A sufficient length of guide wire 26 for the width of the seam to be joined is wound about spool 20 concentric with the windings of pintle yarn 24. The free end 32 of the guide wire 30 is oriented through opening 14 of the circumferential leg **10*b* of cover 10 as the spool 20 is oriented in cover 10. Spool 20 may include a hole 24 or other means to assist in rotating the spool when it is oriented within cover 10**.

The preferred size and shape of the apparatus 5 of the present invention provides a convenient shipping and handling apparatus for use when seaming a papermakers fabric. The ring shape of the apparatus is easily held in one hand by an operator, freeing the other hand to insert the guide wire, or to rotate the spool 20 with respect to the cover 10 to respool the guide wire/pintle yarn combination if necessary. The preferred embodiment even allows the operator to use the thumb on the hand holding the apparatus to rotate the spool 20 with respect to cover 10 to allow more freedom in directing the guide wire/pintle yarn combination through a seam 40 with the free hand. The exposed first end 32 of the guide wire 26 is typically provided with a removable protective cover 34 during shipping and handling.

In use, the present invention greatly simplifies the insertion of a pintle yarn 24 into a fabric seam 40, as in joining the ends 42 and 44 of a belt in a papermaking machine. The apparatus 5 allows for the easy storage and handling of a variety of shapes and sizes of pintle yarn with an appropriately sized guide wire.

In use, protective cover 34 of the guide wire 26 is removed and the guide wire 26 is inserted into the fabric seam to be closed. As the guide wire 26 is being inserted into the fabric seam, the wire is withdrawn from the apparatus 5 by rotation of spool 20 in a clockwise direction with respect to cover 10 either by pulling on the guide wire or by manually rotating the spool 20 with respect to the cover 10 as described above. If during insertion, it is necessary to withdraw a portion or all of the guide wire from the seam, the withdrawn wire may be easily respooled by rotating the spool 20 counterclockwise with respect to cover 10 to prevent tangling or kinking of the pintle yarn/guide wire combination.

Relative rotation between spool 20 and cover 10 is facilitated by holes 24 and 16 respectively and by a cover 10 configuration which in combination with spool 20 defines a cavity 11 yet allows a portion of spool 20 to remain exposed for manipulation. Upon insertion of the guide wire 26 into the seam, the pintle yarn 24 is pulled through the seam by the guide wire 26. The pintle yarn 24 is then cut from the spool 20 and guide wire 26 and the ends trimmed and staked in a conventional manner.

Spool 20 and guide wire 26 may be reused. If sufficient pintle yarn remains on the spool, the guide wire may be reattached with a new swedge 30 and the guide wire 26 rewound upon spool 20 for reuse. Because many end users do not have the proper equipment to reattach a new swedge 30, it is preferable to supply a spool 20 and guide wire 26 with sufficient pintle yarn 24 to fill a number of seams. For example, a spool 20, guide wire 26 and pintle yarn 24 combination may include up to three times the pintle yarn 24 length required to fill a seam. Upon inserting the guide wire 26, the full length of the pintle yarn 24 is pulled through the seam. The excess pintle yarn 24 with guide wire 26 still attached is severed and respooled. Thus, a single original manufacturers swedge attachment between guide wire 26 and pintle yarn 24 may be employed in closing a number of seams. A typical pintle yarn 24 material exhibits an abrasion resistance and tenacity such that repeated pulling through the seams has substantially no effect on the integrity of the seam closed by a pintle yarn 24 which has been pulled through a number of seams in this manner.

The close frictional contact between cover 10 and spool 20 while surface **20*d* of spool 20 remains exposed allows for the manipulation of spool 20 to unwind or wind the guide wire 26 pintle yarn 24 combination. For example, if during insertion the guide wire 26 into a seam, there is some problem such as misalignment, the guide wire 26 can be completely removed from the seam and easily rewound upon spool 20 and the insertion process started over. Further, the frictional fit between the cover 10 and the present invention allows the cover 10 and spool 20** to be easily separated when the supply of pintle yarn is exhausted or so that a guide wire may be attached to the pintle yarn for spooling and reuse.

It should be understood that the foregoing description is not intended to be limiting but is only exemplary of the invention which is defined in the claims.

What is claimed is:

1. A two piece, ring-shaped apparatus for storing and handling a seaming element for a papermaker's fabric, said apparatus comprising:

(a) a ring-shaped, open center spool element for receiving a seaming element thereabout, said spool having a base which defines the minimum open center diameter of said spool and at least one upright thereon which defines the maximum diameter of said spool, said seaming element received about said spool between said minimum and maximum diameters; and (b) a ring-shaped, open center cover element having a generally U-shaped radial opening that is substantially equal to said upright and encloses said spool element on the sides adjacent to and opposite said upright, said cover and said spool retained by a friction fit between said radially disposed opening and said spool.

2. The apparatus of claim 1, wherein said seaming element comprises a pintle yarn affixed to a guide wire.

3. The apparatus of claim 2, wherein a first end of said pintle yarn is attached to said spool, a second end of said pintle yarn is attached to a first end of said guide wire and a second end of said guide wire extends through said opening.

4. A two piece ring shaped apparatus, having an unobstructed center opening, for storing and dispensing an industrial fabric seaming element, said apparatus comprised of:

(a) a one piece, open center circular spool element having a generally U-shaped configuration which defines a three sided, circumferential seaming element cavity; and (b) a one piece, open center circular cover having a generally U-shaped configuration which defines a three sided radial opening which receives said circular spool therein and closes the fourth side of said circular spool seaming element cavity, said cover and said spool retained together solely by a friction fit between the two, said cover having an opening therethrough for dispensing the seaming element from said seaming element cavity.

5. The apparatus of claim 4, wherein said seaming element comprises a pintle yarn affixed to a guide wire.

6. The apparatus of claim 4, wherein:

(a) the first end of said pintle yarn is attached to said spool, and (b) the second end of said pintle is attached to the first end of said guide wire and the second end of said guide wire freely extends through said opening.

7. The apparatus of claim 5, wherein said spool and said cover include means to allow for reversible rotation of said spool with respect to said cover.

* * * * *

UNITED STATES PATENT AND TRADEMARK OFFICE

CERTIFICATE OF CORRECTION

PATENT NO. : 4,842,212

DATED : June 27, 1989

INVENTOR(S) : Andre Loiselle, et al

It is certified that error appears in the above-identified patent and that said Letters Patent is hereby corrected as shown below:

Column 4, lines 12 and 13, delete the word "manufacturers" and insert therefor --manufacturer's--.

Claim 7, column 6, line 11, delete the numeral "5" and insert therefor --4--.

Signed and Sealed this

Seventeenth Day of April, 1990

*Attest:*

HARRY F. MANBECK, JR.

*Attesting Officer*

*Commissioner of Patents and Trademarks*